US006935659B1

(12) United States Patent
Weaver

(10) Patent No.: US 6,935,659 B1
(45) Date of Patent: Aug. 30, 2005

(54) NON-SKID ATTACHMENT FOR WRITING PAD

(76) Inventor: Richard H. Weaver, 2721 Sunrise Dr., Arlington, TX (US) 76006

( * ) Notice: Subject to any disclaimer, the term of this patent is extended or adjusted under 35 U.S.C. 154(b) by 0 days.

(21) Appl. No.: 10/922,588

(22) Filed: Aug. 20, 2004

(51) Int. Cl.[7] ..... B42D 17/00
(52) U.S. Cl. ..... 281/44; 211/45; 211/50; 248/441.1; 248/444; 281/45; 462/72; D19/92
(58) Field of Search ..... 281/42, 44, 45; 248/441.1, 444; 211/45, 50; 462/71, 72; D19/92

(56) References Cited

U.S. PATENT DOCUMENTS

| | | | | | |
|---|---|---|---|---|---|
| 2,195,677 | A | | 4/1940 | Moody et al. | |
| 2,573,323 | A | | 10/1951 | Eshelman | |
| 2,965,394 | A | | 12/1960 | Bresler | |
| 3,937,491 | A | | 2/1976 | Hilding | |
| 5,186,684 | A | * | 2/1993 | Weinberger | 462/17 |
| 5,232,247 | A | * | 8/1993 | Shields | 281/44 |
| 5,248,280 | A | * | 9/1993 | Lockwood et al. | 462/19 |
| 5,427,254 | A | * | 6/1995 | Knieriem | 211/50 |
| 5,673,942 | A | * | 10/1997 | Despointes | 281/44 |
| 6,217,443 | B1 | * | 4/2001 | Green, Jr. | 462/19 |

* cited by examiner

*Primary Examiner*—Monica S. Carter
(74) *Attorney, Agent, or Firm*—Bracewell & Giuliani LLP

(57) ABSTRACT

A pouch or holder has a friction-enhanced surface. The pouch has an opening to receive a cardboard backing of a writing pad. The sheets of paper of the writing pad overlie the upper surface of the pouch. The friction-enhanced material is located at the lower surface of the pouch. The pouch is closed at the bottom end and the side edges. The binding of the writing pad locates on the outside of the pouch.

19 Claims, 2 Drawing Sheets

NON-SKID ATTACHMENT FOR WRITING PAD

FIELD OF THE INVENTION

This invention relates in general to writing pad accessories, and in particular to a pouch that releasably receives a writing pad to prevent slippage of the pad while in use.

BACKGROUND OF THE INVENTION

A typical writing pad or tablet has a stiff cardboard backing and a number of sheets of paper attached to it along the top edge by a binding. These types of writing pads are often used to take notes and messages while using the telephone. Most users will hold the telephone receiver in one hand and a writing instrument in the other hand. As the user writes, the pad may slip due to the lateral forces applied by the user. A slipping pad can be irritating and creates a messy note or message.

Desk pads for placement on top of a desk have been used for many years. When a user places a note pad on a desk pad, the tendency to slip may be less because the desk pad might provide more of a friction surface than a desk or table top. However, there may not be room on a table or credenza adjacent a telephone for a desk pad. Various notepad holders have been proposed in the past, some of which may reduce slippage. Also, there have been proposals to apply a friction-enhancing surface directly to the outer side of the cardboard backing of a notepad.

SUMMARY OF THE INVENTION

In this invention, a notepad holder has parallel upper and lower supporting surfaces that are joined at an end and at two side edges. The stiff backing of a writing pad inserts between the upper and lower surfaces and is retained therein. The sheets of paper of the writing pad overlie the upper surface.

A base layer is attached to an outer side of the lower supporting surface. The base layer is made of a friction enhancing material, such as cork. Preferably the upper and lower supporting surfaces are formed of a flexible vinyl film. Also, preferably the upper and lower supporting surfaces are rectangular, defining a pouch into which the backing of the writing pad releasably inserts.

DETAILED DESCRIPTION OF THE INVENTION

Figure 1:
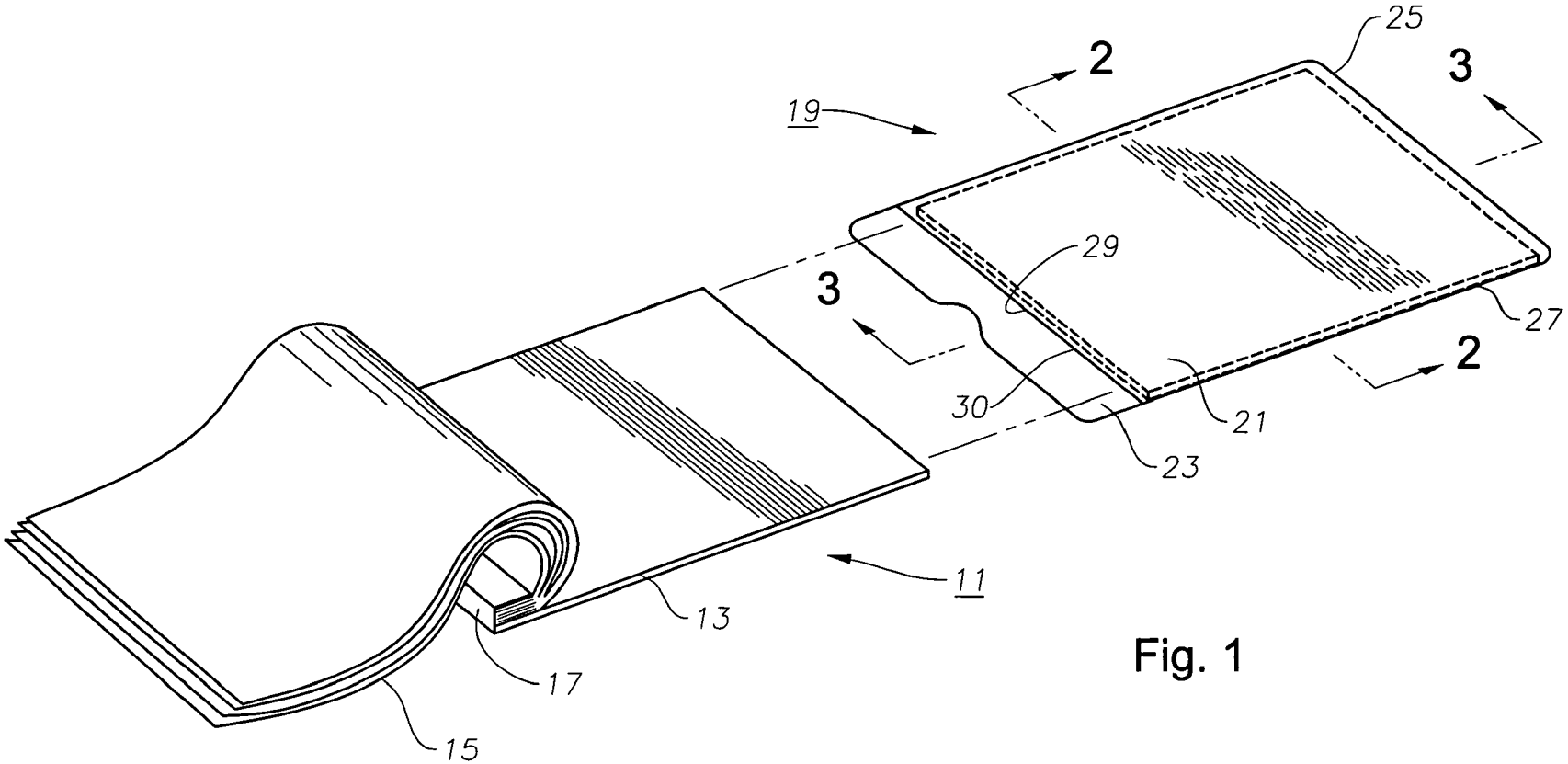
FIG. 1 is a perspective view illustrating a writing pad in exploded form relative to a notepad holder constructed in accordance with this invention.

Referring to FIG. 1, writing pad 11 is a conventional tablet. Writing pad 11 has a stiff cardboard backing 13. A binding 17 attaches the top end of sheets of paper 15 to writing pad 11. When used, the sheets of paper 15 can be individually torn from binding 17, if desired.

A pouch or holder 19 is adapted to receive backing 13 of writing pad 11. Pouch 19 comprises an upper surface or sheet 21 and a lower surface or sheet 23. Upper and lower sheets 21, 23 are secured by a seam at bottom end 25. Side edges 27 of upper and lower sheets 21, 23 are secured by seams. The seams at side edges 27 and bottom end 25 define a pouch 19 closed on three sides and having a top opening 29. The seams are formed conventionally, such as by heat and pressure.

In the preferred embodiment, sheets 21, 23 comprise flexible vinyl sheets. Preferably, sheets 21, 23 are rectangular and substantially coextensive with each other. In the embodiment shown, lower sheet 23 is somewhat longer than upper sheet 21, resulting in a tab 30, however this is not critical to the invention. The width between the seams at side edges 27 is selected to be slightly larger than the width of writing pad backing 13. The length between top opening 29 and bottom end 25 is preferably slightly less than the length from the bottom edge of backing 13 to binding 17. As a result, when assembled, shown in FIG. 3, binding 17 will protrude past top opening 29 and overlie tab 30.

Figure 2:
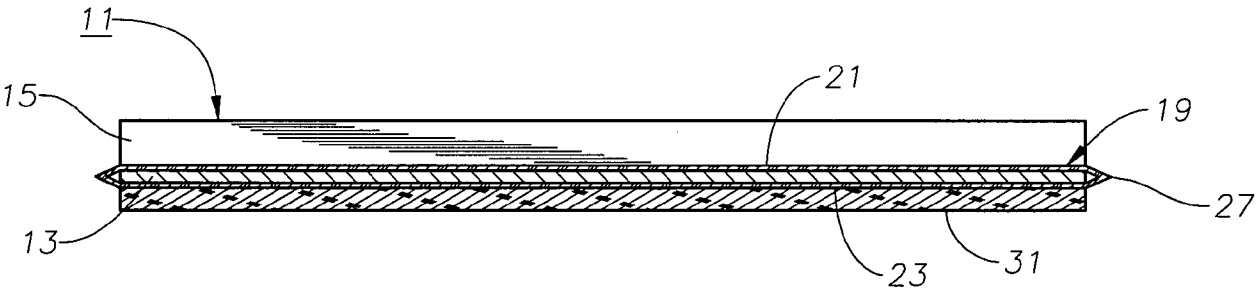
FIG. 2 is a sectional view of the notepad holder and the writing pad assembled together and taken along the line 2—2 of FIG. 1.
Figure 3:
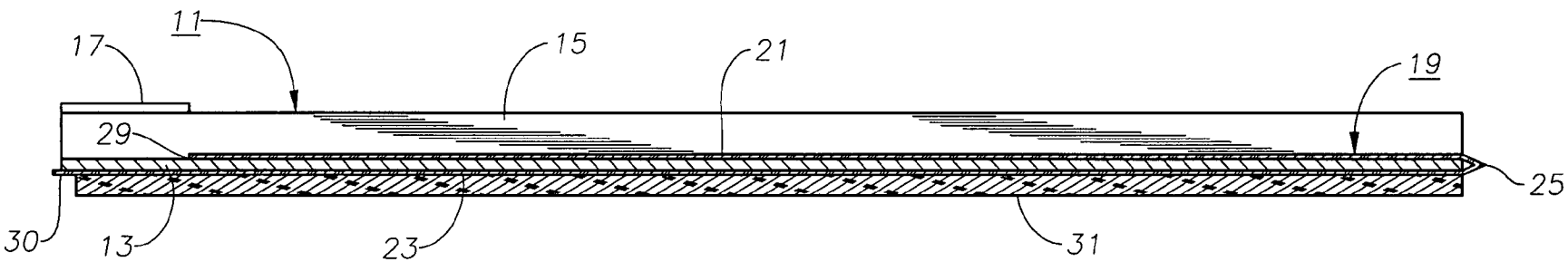
FIG. 3 is a sectional view of the notepad holder and writing pad assembled together and taken along the line of 3—3 of FIG. 1.

Referring to FIGS. 2 and 3, a non-skid layer 31 is secured to the outer side of lower sheet 23 by a suitable adhesive. Non-skid layer 31 increases friction more than the cardboard material of writing pad backing 13. For example, non-skid layer 31 may be of a cork material, or of some type of soft elastomeric material. In the preferred embodiment, non-skid layer 31 has a width that is substantially coextensive with the width between side edges 27, shown in FIG. 2. As shown in FIG. 3, preferably non-skid layer 31 has a length that is substantially the same as from bottom end 25 to opening 29. Non-skid layer 31 is preferably rectangular and has a surface area that is at least 75% of the surface area of lower sheet 23.

In use, the user inserts cardboard backing 13 into pouch 19 as shown in FIGS. 2 and 3. Backing 13 will be located between upper and lower sheets 23. Binding 17 locates over tab 30 and past opening 29. The pages or sheets of paper 15 overlie upper sheet 21.

As the user writes on paper 15 and pad 11, lateral forces due to the writing instrument are resisted by the frictional gripping of non-skid layer 31 on the supporting surface, such as a table or credenza. This allows the user to freely write with one hand while using the other hand to hold a telephone receiver. When a page of paper 15 is completed, if desired, the user can slide it into pouch 19 along with backing13. Preferably pouch 19 has sufficient width to allow substantially all of the pages of paper 15 to be inserted into pouch 19, leaving only the clean pages of paper 15 on top of upper sheet 21. Alternately, the user could tear the pages of paper 15 from binding 17 after use. When the user has completed use of writing pad 11, he pulls backing 13 from pouch 19 and inserts another writing pad 11 in place.

The invention has significant advantages. The pouch provides friction to reduce slippage, yet takes up no more room than the writing pad itself. The pouch is reusable and inexpensive.

While the invention has been shown in only one of its forms, it should be apparent to those skilled in the art that it is not so limited but is susceptible to various changes without departing from the scope of the invention. For example, the upper and lower sheets could be rigid, rather than flexible. In addition, if rigid, a central opening could be provided in the upper and lower sheets.

I claim:

1. An apparatus for writing, comprising:

parallel, upper and lower supporting surfaces that are joined at an end and two side edges;

a writing pad having a stiff backing and sheets of paper secured thereto, the backing of the writing pad being between the upper and lower supporting surfaces, and the sheets of paper overlying the upper supporting surface, the writing pad being removable from the upper and lower supporting surface; and a base layer attached to an outer side of the lower supporting surface, the base layer being of a friction-enhancing material.

2. The apparatus according to claim 1, wherein the upper and lower supporting surfaces are formed of a flexible vinyl film.

3. The apparatus according to claim 1, wherein the upper and lower supporting surfaces are co-extensive with each other and rectangular.

4. The apparatus according to claim 1, wherein each of the upper and lower supporting surfaces has an area that is greater than an area of the backing of the writing pad.

5. The apparatus according to claim 1, wherein the base layer is attached to the outer side of the lower supporting surface by adhesive.

6. The apparatus according to claim 1, wherein the base layer is rectangular.

7. The apparatus according to claim 1, wherein the base layer has an area that is at least 75 percent of the area of the outer side of the lower supporting surface.

8. The apparatus according to claim 1, wherein the base layer is formed of a cork material.

9. An apparatus for stabilizing a writing pad against slippage, comprising:

a pouch having rectangular first and second sheets that are joined at an end and two side edges, the pouch having an opening opposite the end for receiving a backing of a writing pad therein with paper of the writing pad overlying the first sheet; and a base layer attached to an outer side of the second sheet, the base layer being of a friction-enhancing material.

10. The apparatus according to claim 9, wherein the base layer is attached to the outer side of the second sheet by adhesive.

11. The apparatus according to claim 9, wherein the base layer is rectangular.

12. The apparatus according to claim 9, wherein the base layer has an area that is at least 75 percent of the area of the outer side of the second sheet.

13. The apparatus according to claim 9, wherein the base layer is formed of a cork material.

14. The apparatus according to claim 9, wherein the first and second sheets of the pouch are formed of a vinyl film.

15. An apparatus for writing, comprising:

a pouch having rectangular upper and lower supporting sheets of a vinyl film that are joined at a bottom end and two side edges, the pouch having an opening at a top end opposite the bottom end;

a writing pad having a stiff backing and sheets of paper secured thereto by a binding along a top end, the backing of the writing pad being releasably inserted into the pouch between the upper and lower supporting sheets, and the sheets of paper overlying the upper supporting sheet; and a base layer attached to an outer side of the lower supporting sheet, the base layer being of a friction-enhancing material.

16. The apparatus according to claim 15, wherein the base layer is rectangular.

17. The apparatus according to claim 15, wherein the base layer has an area that is at least 75 percent of the area of the outer side of the lower supporting surface.

18. The apparatus according to claim 15, wherein the base layer is formed of a cork material.

19. The apparatus according to claim 15, wherein the binding protrudes from the opening of the pouch.

* * * * *